United States Patent [19]

Otteman et al.

[11] Patent Number: 4,691,669

[45] Date of Patent: Sep. 8, 1987

[54] ENGINE OVERHEAT PROTECTION SYSTEM

[76] Inventors: John H. Otteman, 4005 Hecker Pass Hwy., Gilroy, Calif. 95020; John R. Lufkin, 5534 Brookmead Dr., Whittier, Calif. 90601

[21] Appl. No.: 840,404

[22] Filed: Mar. 17, 1986

[51] Int. Cl.[4] ..... F01P 11/16; F01P 11/18

[52] U.S. Cl. ..... 123/41.15; 340/57; 374/145

[58] Field of Search ..... 123/41.15; 340/57; 374/145

[56] References Cited

U.S. PATENT DOCUMENTS

| | | | |
|---|---|---|---|
| 3,518,887 | 7/1970 | Armbrust | 123/41.15 |
| 3,739,366 | 6/1973 | Lace | 123/41.15 |
| 4,147,151 | 4/1979 | Wright | 123/41.15 |
| 4,587,931 | 5/1986 | Duprez | 123/41.15 |

*Primary Examiner*—William A. Cuchlinski, Jr.
*Attorney, Agent, or Firm*—Donald D. Mon

[57] ABSTRACT

A protection system for internal combustion systems which indicates and alarms the loss of coolant liquid which it detects as a pressure drop at higher temperatures, and then sets off an alarm.

7 Claims, 1 Drawing Figure

ENGINE OVERHEAT PROTECTION SYSTEM

FIELD OF THE INVENTION

This invention relates to internal combustion engine overheat protection systems and more particularly relates to systems for protection against the loss of engine coolant.

BACKGROUND OF THE INVENTION

Liquid cooled internal combustion engines are critically dependent on their coolant systems. Especially for larger engines such as are used for heavy trucks, construction equipment, and large stationary installations, the loss of engine coolant can result in destruction of the engine in fractions of a minute. The damage occurs well before even an alert driver can detect the problem. The loss of coolant is more critical than a mere insufficiency of coolant or some other situation where the engine simply runs too hot, but still within a range where the problem will likely be discovered in time to shut down the engine before the engine destroys itself. While this invention is at least partially responsive to these circumstances, the detection of these problems is not the primary objective of this invention.

The substantially total loss of coolant is the problem addressed by this invention. It is an object of this invention to enable it promptly to be detected and alarmed against. However, the system must also sort out other potentially confusing situations so that it will not alarm unnecessarily.

Therefore, it is one object of the present invention to provide a detection system which detects and alerts the driver to loss of coolant.

It is yet another object of the present invention to provide a pressure sensitive system which reacts to pressure in a coolant system, alerting a driver when pressure drops suddenly under circumstances where consequent overheating is dangerous.

A preferred object of the invention is that the system be adaptable to existing engine and cooling systems, so that the system can be simply mechanically connected in the flow of coolant in existing systems.

BRIEF DESCRIPTION OF THE INVENTION

The present invention provides a coolant loss detection system which detects loss of pressure of coolant in the system and thereby indicates to the driver the loss of coolant at certain engine temperature conditions.

The system of this invention includes a pressure sensor and a temperature sensor. Each includes a switch means which can be either conductive or non-conductive. Its inactivated condition is called normally closed or normally open respective to the system design. These sensors are exposed to the coolant, preferably by being plumbed into the coolant system. The switch-over parameters of the switches are such as to be responsive to cold start, engine warm up, normal operation, and pressure loss at high temperature. Alarm means is provided to alarm against the last of these.

As an optional but preferred feature of the invention, latching, delay timer, and noise suppression circuits can be included in series with the pressure and temperature sensors. The latching circuitry may be a pulse operated circuit which keeps the alarm on once an alarming pulse has flowed through the pressure-temperature sensing series ciruit. Alternatively, the latch can be a delay timer which keeps the alarm on for a predetermined period of time then turns off if the condition should return to normal within a predetermined period of time. The delay timer can also act as an intermittent noise suppression circuit so that momentary drops or surges in pressure will not activate the alarm. Only when the pressure has suddenly dropped and remains at a low level for several seconds, will the alarm then be activated.

The above and other features of the invention will be fully understood from the following detailed description and the accompanying drawings, in which:

DETAILED DESCRIPTION OF THE INVENTION

Figure 1:
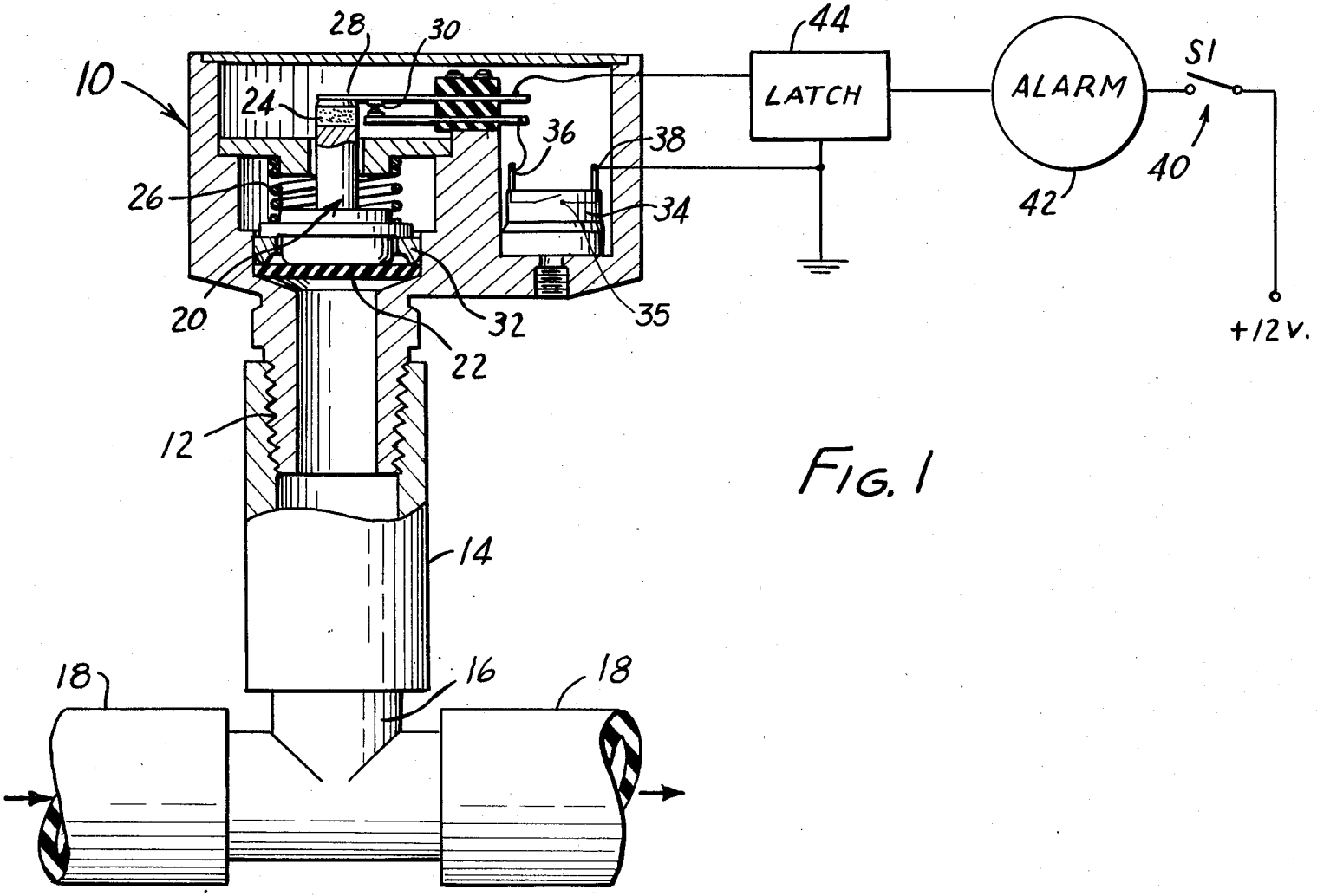
FIG. 1 is a semi-schematic drawing illustrating the configuration and operation of the invention.

The coolant loss detection system is illustrated in FIG. 1. It includes a housing 10 having a hose nipple 12 for plumbing the system into an existing coolant system. A hose 14 attached to a tee 16 can conveniently be interposed in a coolant hose 18 in an existing internal combustion engine cooling system. The connection shown allows coolant flowing from hose 18 also to flow to the nipple 12 through hose 14.

Mounted in the housing 10 is a pressure sensor 20 comprised of a diaphragm 22, and a piston 24, under load by spring 26. The piston 24 is in contact with one leaf 28 of a normally closed switch 30. By normally closed is meant that it conducts, or makes a circuit, at low enough pressures that it is inactivated Diaphragm 22 is at rest, and the piston 24 is biased by spring 26 against abutment 32. Switch 30 thus remains closed at low pressures, and opens at suitably high pressures.

Also included in housing 10 is a temperature sensor 34 with a thermal switch 35 connected in series with pressure switch 30. Switch 35 is normally open, that is, it breaks the circuit, at low enough temperatures that it is inactivated, preventing the flow of current. It closes and conducts current at a suitably high temperature. Sensor 34 detects heat conducted by a housing mounted either on the engine or in close proximity to some surface heated by the engine to detect operating temperatures. Since the sensor 34 has terminal 36 connected in series with switch 30, and terminal 38 connected to ground, then as long as either the pressure sensor 20 or the temperature sensor 34 is open, no current can flow through the coolant loss detecting system.

Also included in the circuit is an on/off switch 40 and an alarm 42. An optional latch 44 which will be described in greater detail hereinafter can also be provided. As long as either pressure switch 24, or sensor 34 is open, no current can flow to activate alarm 42 with switch 40 closed. Alarm 42 only operates when both the pressure switch 20 and switch 35 under control of sensor 34 are closed. That is, when the temperature is high and the pressure is low, current will be drawn through the circuit activating the alarm 42 which can be an audio or a visual alarm or both. The alarm circuit operates according to the following conditions:

| Engine Condition | Normally Closed Pressure Switch | Normally Closed Temperature Switch | Alarm |
|---|---|---|---|
| Cold Start | Closed | Open | Off |

-continued

| Engine Condition | Normally Closed Pressure Switch | Normally Closed Temperature Switch | Alarm |
|---|---|---|---|
| Warm Up Standard Operation | Open | Open | Off |
| Warm Engine Full Coolant | Open | Closed | Off |
| Sufficient pressure, Excessive Temperature | Open | Closed | Off |
| Low Pressure and High Temperature | Closed | Closed | On |

As can be seen by the above chart, the alarm remains deactivated under most operating conditions except for a pressure loss which may occur because of a break in a hose or conduit, a loose cap, or excessive evaporation of coolant when the engine is hot. This condition indicates to a driver that he should immediately stop the engine to prevent damage as the loss of coolant can cause such excessive and rapid overheating as will damage the engine. Normal overheating without pressure loss will usually not cause the severe damage that loss of coolant and pressure can cause.

A latch 44 can be provided in the circuit to keep the alarm 42, once activated, in an activated position, unaffected by any subsequent change in temperature or pressure. Thus, the alarm 42, once activated, will continue to operate until deactivated by a switch S1 which may or may not be the engine ignition system. The entire system is reset by turning switch S1 on, off, and then back on. Should the low pressure condition still exist, the alarm will be reactivated. The latch 44 can also be in the form of a delay timer which will desensitize the circuit to momentary pressure surges or drops. Such a delay timer will act as a noise suppression device preventing activation of the alarm unless the low pressure condition exists for a predetermined period of time. For example, a 555 integrated circuit timer and appropriate circuitry can be configured to be activated after a period of a second or two or even a portion of a second should the pressure sensed by pressure sensor 20 drop below its predetermined level and remain there for more than a moment. If these optional devices are not used, then the switches can be connected directly to the alarm. The system is connected to battery and ground as illustrated.

The system disclosed and described is adaptable to any existing engine using a coolant. It requires no modification of the existing coolant system other than tapping into a flow line from the coolant. It can be installed anywhere on the pressurized side of the coolant system but preferably in the heater hose. The system is not primarily a temperature sensing system indicative of coolant flow or of low coolant supply. Excessive temperatures generally do not cause damage unless they exist for a sufficient period of time along with a loss of coolant fluid. Then damage is swift and serious. This system will alarm when the radiator cap is loose, as well as when coolant is lost.

The system senses an extreme drop or loss of coolant such as a break in the coolant hoses or a loose radiator cap which can prevent coolant pressure from increasing sufficiently to provide protection. Preferably, the temperature sensor 34 changes its condition from open to closed at temperatures in the range of about 160 degrees Fahrenheit. The pressure switch sensitivity is controlled by the resiliency of spring 26 and diaphragm 22 but it should generally be in the range of approximately two pounds per square inch (2 psi). In larger systems, the pressure sensitivity may be in the range of 5 psi.

The inclusion of the optional latching mechanism keeps the alarm circuit on, even though the system may return to normal, providing an indication that a potential serious condition has occurred. Preferably, the pressure switch, the temperature sensor, the alarm circuits, and other appropriate circuitry are all included in a single enclosure which can readily be attached or installed in existing coolant systems. As was stated previously a switch S1 can be an existing ignition switch or a separate switch as preferred. The system is thus easily adapted to an existing vehicle without any substantial modification other than tapping a coolant hose. Temperature sensor 34 being sensitive to heat conducted to it, detects heat either from the housing 10 itself, or it may instead have a heat conducting probe for detecting temperature.

This invention is not to be limited by the embodiments shown in the drawings shown and described in the description which are given by way of example and not of limitation but only in accordance with the scope of the appended claims.

We claim:

1. A coolant system protection system for internal combustion engines comprising;

a housing;

a normally closed switch means in said housing;

coolant fluid pressure sensitive means constructed and arranged to operate said normally closed switch means so that said normally closed switch means remains closed at a lower pressure and opens at a higher pressure;

fluid connecting means connecting said coolant fluid pressure sensitive means to detect and respond to coolant fluid pressure;

temperature sensitive switch means mounted in said housing, said temperature sensitive switch means being normally open at a lower temperature and closed at a higher temperature;

said normally closed switch means and said temperature sensitive switch means being connected in series;

alarm means connected in series with said normally closed switch means and temperature sensitive switch means; and electrical power supply means connected to said alarm means;

whereby said alarm is activated when fluid pressure is low and temperature is high to indicate coolant loss and higher temperatures concurrently.

2. A system according to claim 1 wherein said fluid pressure sensitive means comprises;

a flexible diaphragm;

a spring loaded piston constructed and arranged to be driven by said diaphragm;

said normally closed switch means being operated by said piston;

said fluid connecting means connecting said diaphragm to coolant flowing in said coolant system.

3. A system according to claim 2 in which said coolant fluid pressure sensitive means changes its condition at pressures above approximately 2 psi.

4. A system according to claim 2 in which said coolant fluid pressure sensitive means changes its condition at pressures above approximately 5 psi.

5. A system according to claim 2 in which said temperature sensitive swtich means changes its condition at about 160 degrees F.

6. A system according to claim 1 including latch means latching said alarm means in an activated position.

7. The device according to claim 6 in which said latch means comprises delay timing means for delaying response of said alarm means to prevent activation by momentary pressure variations even at higher temperatures.

* * * * *